US007702248B2

(12) United States Patent
Adachi et al.

(10) Patent No.: US 7,702,248 B2
(45) Date of Patent: Apr. 20, 2010

(54) POWDER CONTAINER, TONER CONTAINER, AND IMAGE FORMING APPARATUS

(75) Inventors: Tomoya Adachi, Osaka (JP); Tomofumi Inoue, Osaka (JP); Takafumi Miyazaki, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 431 days.

(21) Appl. No.: 11/616,664

(22) Filed: Dec. 27, 2006

(65) Prior Publication Data

US 2007/0147859 A1 Jun. 28, 2007

(30) Foreign Application Priority Data

Dec. 28, 2005 (JP) ..... 2005-380285

(51) Int. Cl.
*G03G 21/12* (2006.01)

(52) U.S. Cl. ..... 399/35; 399/360

(58) Field of Classification Search ..... 399/9, 399/13, 34, 35, 123, 343, 358, 360
See application file for complete search history.

(56) References Cited

U.S. PATENT DOCUMENTS

| | | | | |
|---|---|---|---|---|
| 7,107,002 | B2 * | 9/2006 | Saito et al. | 399/360 |
| 7,373,092 | B2 * | 5/2008 | Tawada | 399/35 |
| 7,515,838 | B2 * | 4/2009 | Kadowaki et al. | 399/13 |
| 7,526,236 | B2 * | 4/2009 | Kubota et al. | 399/257 |
| 2004/0033094 | A1 | 2/2004 | Saito et al. | |

FOREIGN PATENT DOCUMENTS

| | | |
|---|---|---|
| JP | 5-257411 | 10/1993 |
| JP | 10-207202 | 8/1998 |
| JP | 11-2947 | 1/1999 |
| JP | 11-305623 | 11/1999 |
| JP | 2000-56648 | 2/2000 |
| JP | 2003-162191 | 6/2003 |
| JP | 2004-102137 | 4/2004 |
| JP | 3604840 | 10/2004 |

OTHER PUBLICATIONS

U.S. Appl. No. 11/580,939, filed Oct. 16, 2006, Inoue et al.

* cited by examiner

*Primary Examiner*—Hoan H Tran
(74) *Attorney, Agent, or Firm*—Oblon, Spivak, McClelland, Maier & Neustadt, L.L.P.

(57) ABSTRACT

A powder container is configured to be installed in a substantially horizontal manner in an apparatus in which the powder container is used. A powder inlet is provided, through which a powder enters into the powder container. A powder detecting unit includes a powder detector for detecting a full of the powder. A powder conveying unit is provided between the powder inlet and the powder detecting unit. A space between the powder inlet and the powder detecting unit is divided into a plurality of areas.

32 Claims, 7 Drawing Sheets

POWDER CONTAINER, TONER CONTAINER, AND IMAGE FORMING APPARATUS

CROSS-REFERENCE TO RELATED APPLICATIONS

The present document incorporates by reference the entire contents of Japanese priority document, 2005-380285 filed in Japan on Dec. 28, 2005.

BACKGROUND OF THE INVENTION

1. Field of the Invention

The present invention relates to a powder container for collecting and accumulating powder such as toner, and an image forming apparatus having the powder container, such as a copier, a printer, and a plotter.

2. Description of the Related Art

In an image forming apparatus, such as a copier, toner remaining after transfer on a photosensitive drum or an intermediate transfer belt after a toner image is transferred to a recording medium or an intermediate member is removed by a cleaning mechanism, and is collected in a powder collecting box for collection and storage in a centralized manner.

The powder collecting box of this type includes a toner inlet connected to the cleaning mechanism, a toner conveying unit that conveys toner introduced to the box, and a toner detecting unit that detects a degree of a toner capacity of the box (fill factor).

Upon detection by the detecting unit that the box is completely filled with toner, the powder collecting box is replaced.

In view of improving user convenience, the number of times of replacing the power collecting box is reduced as much as possible. To achieve this, the capacity of the box is desirably increased as much as possible.

However, as has been well known, more downsizing and cost reduction have been seen in the image forming apparatus of this type and, in reality, increasing the size of the box only in view of improving powder collectability is not allowed.

The powder collecting box is often placed by using a so-called dead space, such as a space between a paper feeding unit placed at the bottom of the image forming apparatus and an image forming unit positioned above the paper feeding unit.

An exemplary configuration of the powder collecting box is such that a toner conveying unit is provided in a toner cartridge in a box shape (see, for example, Japanese Patent Application Laid-Open No. H11-002947). In this configuration, an eccentric cam is provided on a shaft of a screw for supplying toner to the outside. With this eccentric cam, a flat plate is caused to reciprocate in a horizontal direction to convey toner with the use of protrusions that are formed integrally with the flat plate and are directed inwardly in a shape of an upward arrow head. Furthermore, the cartridge has also provided therein a configuration for detecting the remaining amount of toner.

On the other hand, as for toner introduced to a developing device for development, it is important to achieve a smooth toner movement to prevent a supply failure. However, some of the accommodated toner may be coagulated to cause a so-called blocking phenomenon, which will inhibit a smooth movement.

To get around this problem, a conventional configuration for loosen toner with such a blocking has been suggested (see, for example, Japanese Patent Application Laid-Open No. H10-207202). In this configuration, in some cases, a plate member that is placed in a developer accommodating unit and is capable of reciprocating is provided, and the plate member is provided with a protruding portion at a toner flow inlet and in the entering toner. By causing the plate member to reciprocate, the protruding portion looses the toner.

However, in view of downsizing, when there is no margin in a height direction of the image forming apparatus body, the dimensional ratio of the powder collecting box inevitably be such that the box is long in a horizontal direction (X and Y directions) and small in a height direction (Z direction). That is, the box shape tends to be a flat shape that is wide in a horizontal direction and low in height.

With such a box shape, it is extremely difficult to evenly accumulate toner, and there is a possibility that the toner may be accumulated as being partially coagulated. If the toner is coagulated near the toner detecting unit, it is detected that the box is filled with toner despite the fact that the entire box is not yet full, and a replacement operation is requested early in a non-full state, thereby leading to deterioration in user convenience.

The technology disclosed in Japanese Patent Application Laid-Open No. H11-002947 is aimed at efficiently supplying toner to the end while preventing coagulation of toner previously accommodated in a cartridge. The conveying direction of the protrusions placed in an upward arrow head is such that, as shown in FIG. 7 of Japanese Patent Application Laid-Open No. H11-002947, the protrusions cause the toner to be unidirectionally headed toward the toner detecting unit through a mutual operation, even though the protrusions cross and differ one another.

Therefore, when this conveying scheme is applied to the powder collecting box, the toner tends to be coagulated near the toner detecting unit, thereby not solving the problem of erroneous detection.

On the other hand, in the technology disclosed in Japanese Patent Application Laid-Open No. H10-207202, the introduced toner is pushed by the reciprocating plate member for movement. However, the introduced toner has the largest amount at an introduction side, and as the toner gradually moves from an introduction inlet, the toner becomes evened in an inner space and the amount to be moved by the plate member is decreased. This may decrease the amount reaching the position of the toner detecting unit. For this reason, in the case where the toner collected in the powder collecting box is deposited in a manner such that the amount of toner is the largest near the introduction inlet and is gradually decreased in the course of reaching the position of the toner detecting unit, if a state occurs such that the movement of toner to be newly introduced to the powder collecting box is inhibited, this state cannot be detected by the toner detecting unit. For example, since a toner-full state cannot be detected, toner will flood near the introduction inlet to pollute an area near a grounding portion of the powder collecting box.

In this manner, if the toner behavior in the powder collecting box is inappropriate, even with provision of the powder detecting unit for detecting a toner-full state, a toner-full state may not be correctly detected by this unit.

SUMMARY OF THE INVENTION

It is an object of the present invention to at least partially solve the problems in the conventional technology.

A powder container according to one aspect of the present invention is configured to be installed in a substantially horizontal manner in an apparatus in which the powder container is used. The powder container includes a powder inlet through which a powder enters into the powder container; a powder detecting unit that includes a powder detector for detecting a full of the powder; and a powder conveying unit that is provided between the powder inlet and the powder detecting unit. A space between the powder inlet and the powder detecting unit is divided into a plurality of areas.

A toner container according to another aspect of the present invention includes a powder container configured to be installed in a substantially horizontal manner in an apparatus in which the powder container is used. The powder container includes a powder inlet through which a powder enters into the powder container, a powder detecting unit that includes a powder detector for detecting a full of the powder, and a powder conveying unit that is provided between the powder inlet and the powder detecting unit. A space between the powder inlet and the powder detecting unit is divided into a plurality of areas.

An image forming apparatus according to still another aspect of the present invention includes a toner container including a powder container configured to be installed in a substantially horizontal manner in an apparatus in which the powder container is used. The powder container includes a powder inlet through which a powder enters into the powder container, a powder detecting unit that includes a powder detector for detecting a full of the powder, and a powder conveying unit that is provided between the powder inlet and the powder detecting unit. A space between the powder inlet and the powder detecting unit is divided into a plurality of areas.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

Exemplary embodiments according to the present invention will be described in detail below with reference to the accompanying drawings.

Figure 1:
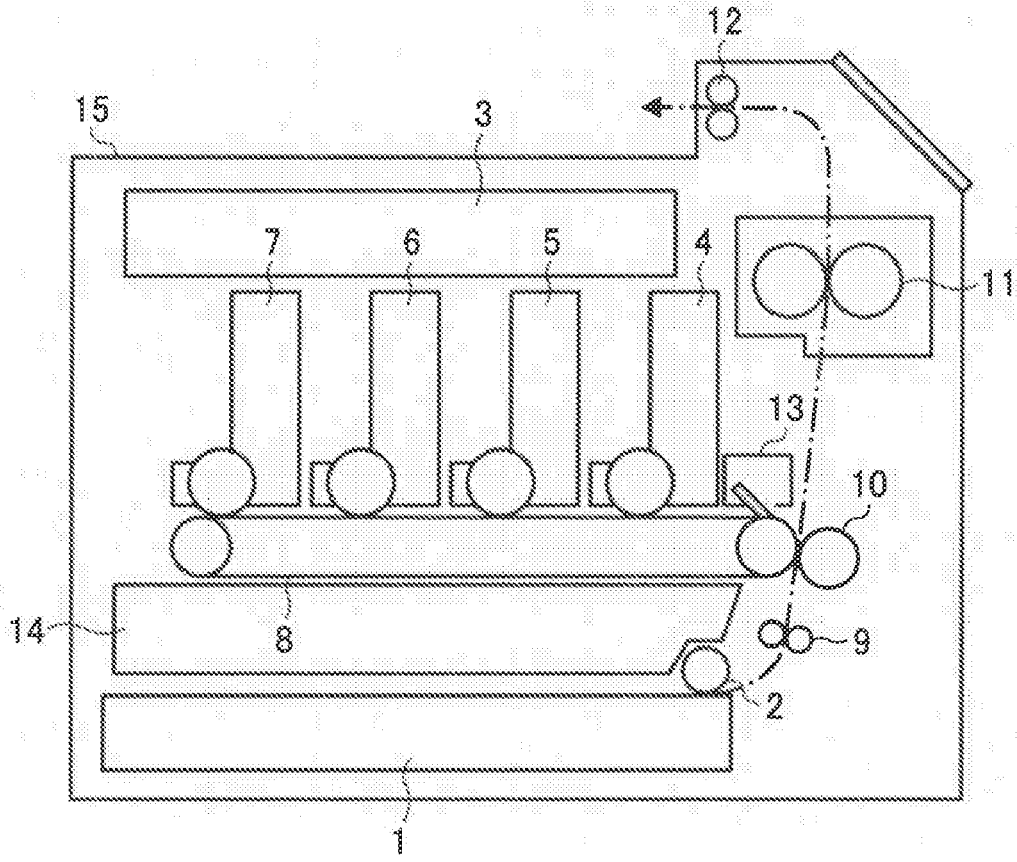
FIG. 1 is a schematic front view of an image forming apparatus in which a powder container according to an embodiment of the present invention is used as a powder collecting container.

With reference to FIG. 1, the entire configuration of an image forming apparatus provided with a toner container including a powder container according to an embodiment is described below.

In the image forming apparatus depicted in FIG. 1, an exposing unit 3 performs optical writes to four image forming units 4, 5, 6, and 7 to form electrostatic latent images. Each latent image is visualized by a developing unit of each image forming unit.

Toner images formed on the respective image forming units are sequentially superposed on an intermediate transfer belt 8 for transfer. One of transfer sheets stacked on a paper feeding cassette 1 is fed by a paper feeding roller 2. After a skewed displacement is corrected by a resist roller pair 9, the paper sheet is sent to a secondary transfer portion at predetermined timing. In the secondary transfer portion, the superposed toner images on the intermediate transfer belt 8 are collectively transferred by a secondary transfer roller 10 onto the transfer paper.

A fixing unit 11 then fixes a color toner image on the transfer sheet as an image, and the image is delivered by a delivery roller pair 12 as an output image to a paper delivery tray 15 on an upper surface of the apparatus.

Toner remaining after transfer on the intermediate transfer belt 8 is removed by a cleaning mechanism 13 from an upper surface of the belt, and is accumulated in a toner container box 14 as a powder container.

In recent years, more downsizing and cost reduction have been seen even in such an image forming apparatus. Also, an improvement in user convenience has been demanded.

Under such circumstances, with the aim of improving user convenience and reducing the number of times of replacing a powder box, the capacity of the powder box is preferably increased as much as possible. However, an increase of the apparatus due to such a capacity increase is not allowed. Therefore, the powder box is often arranged in such a state to fill a dead space in the configuration of the apparatus.

In the image forming apparatus according to the embodiment of the present invention, the paper feeding roller 2 and the secondary transfer roller 10 is required to be spaced apart to a certain degree for paper conveyance. This tends to cause a dead space, where the powder container, such as a toner container box, is often placed.

However, with the configuration, as already mentioned above, the following problems will occur.

Since a dimensional ratio of the powder box is such that dimensions in X and Y directions are large whilst a dimension in a Z direction is small, it is extremely difficult to evenly accumulate toner. If the toner is accumulated with part of the toner being solidified, powder (hereinafter also referred to as "toner") cannot be conveyed to cause clogging, thereby leading to inconveniences at other portions and also an inconvenience of significant deterioration in detection accuracy of powder-amount-full detection (full detection).

According to studies by the inventors, to control powder so that the powder is evenly accumulated, a plurality of flows has to be created at different positions on a horizontal plane and in different directions.

Figure 8:
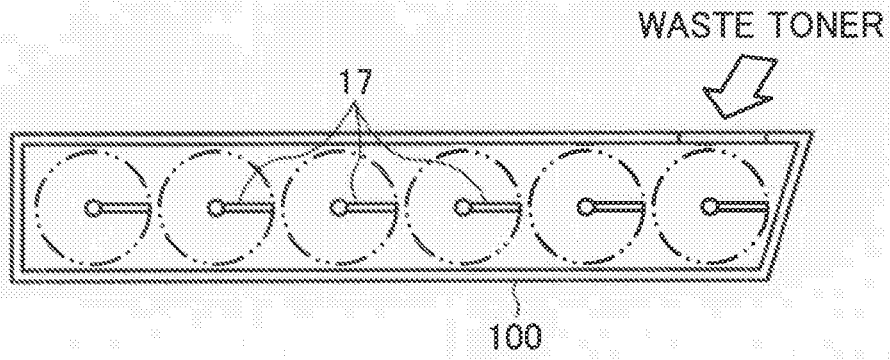
FIG. 8 is an assumed configuration drawing for obtaining uniform conveyance.
Figure 9:
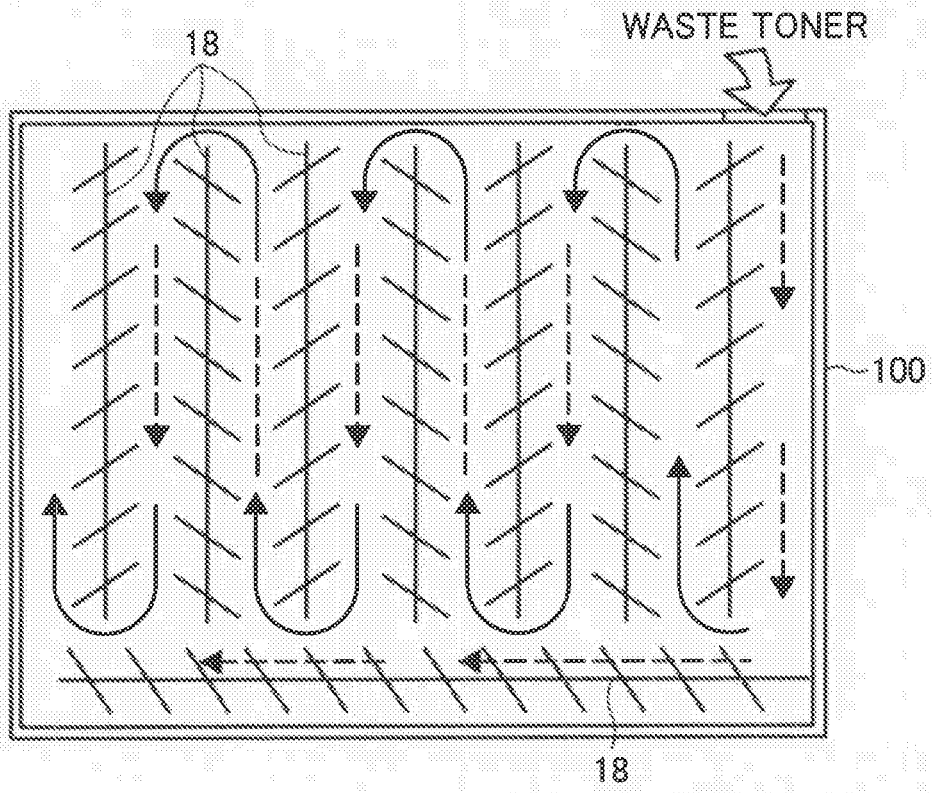
FIG. 9 is another assumed configuration drawing for obtaining uniform conveyance.

To achieve this, as shown in FIG. 8, for example, an exemplary configuration is such that toner agitating sticks 17 are placed to cover the entire area of a bottom surface portion of a powder box 100. In another exemplary configuration, as shown in FIG. 9, a plurality of conveyor screws 18 are placed.

However, in such schemes, the configuration for driving agitating units, such as the toner agitating sticks 17 and the conveyor screws 18, is inevitably complex and expensive.

That is, to rotate the agitating units simultaneously in different directions, a complex gear line has to be required.

Moreover, even with such a complex gear line, this gear line merely reverses the toner conveying direction. Therefore, it is difficult to finely control the toner flow and the amount of toner flow, and the problem of low accuracy of powder-amount-full detection cannot yet be solved.

In view of the circumstances, an object of the present embodiment is to provide a powder container capable of easily and accurately controlling the toner flow and the amount of toner flow with a simple configuration and increasing the accuracy of powder-full detection by reliably moving toner to the position of the powder-full detecting unit.

Figure 2:
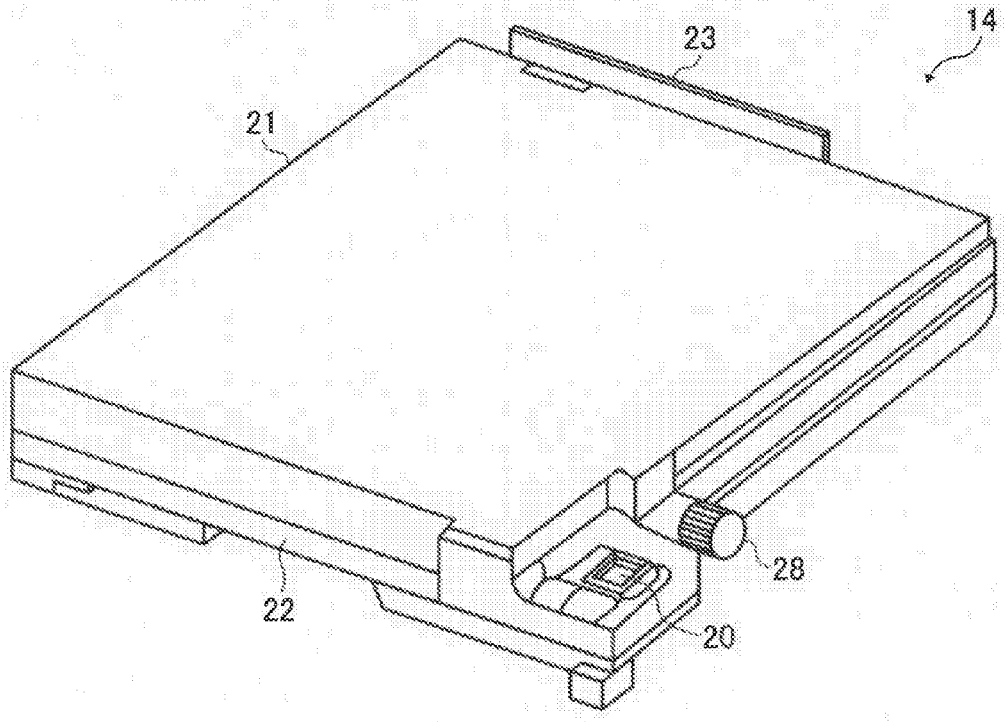
FIG. 2 is an entire perspective view of the powder collecting container.

The toner container box 14 as a powder container for use according to the present embodiment includes, as shown in FIG. 2, an upper case 21 having a powder inlet 20, a lower case 22, a powder-full detecting unit 23, and others. The powder inlet 20 has connected thereto a powder transfer hose not shown extending from the cleaning mechanism 13, through which powder is introduced.

Figure 3:
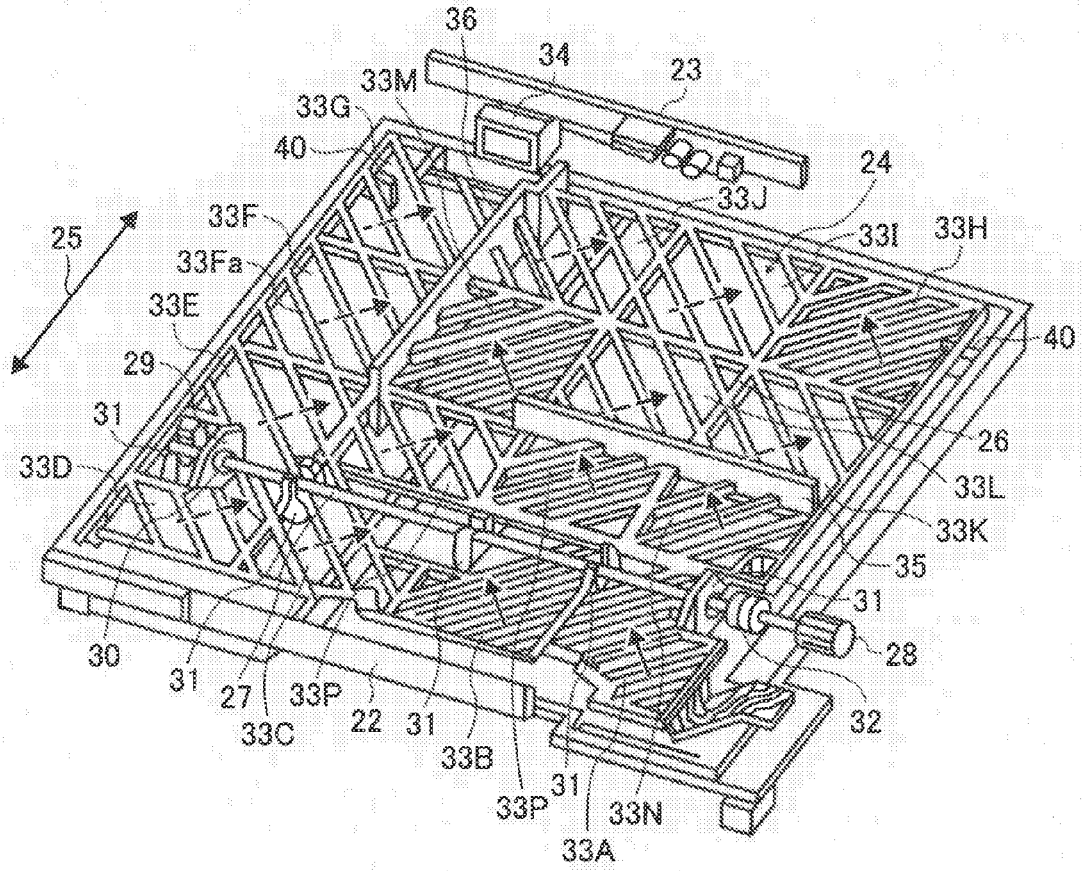
FIG. 3 is a perspective view that depicts a conveying direction in each conveying unit of the powder collecting container.

As shown in FIG. 3, the lower case 22 has accommodated therein a powder conveying unit 24. The powder conveying unit 24 includes an agitating plate 26 that performs an approximately reciprocating movement in a horizontal direction as indicated by an arrow 25, a cam shaft 27, a driving gear 28 fixed to one end of the cam shaft 27 and connected to a driving source of an image forming apparatus not shown, an eccentric cam 30 provided at the other end of the cam shaft 27 and accommodated in a cam receiving unit 29 integrally formed with the agitating plate 26, and other components.

The cam shaft 27 is supported by a plurality of supporting pieces 31 integrally formed with the agitating plate 26. The cam shaft 27 is divided at the driving gear 28 side, and the divided portions are connected by a coupling 32.

The powder-full detecting unit 23 has a powder-full detector 34 as a powder detecting unit. As the powder-full detector 34, an optical reflective photosensor can be used.

The agitating plate 26 is integrally formed of synthetic resin, and has a plurality of conveying units 33A, 33B, 33C, . . . , 33P placed on an approximately horizontal plane at different positions. Each conveying unit 33 is partitioned in a rectangular shape by ribs running vertically and horizontally, and is formed of conveying members with a plurality of sheathing board portions (denoted as 33Fa as for the conveying unit 33F) having an angle on an approximately horizontal plane with respect to the moving direction of the powder conveying unit 24 (the reciprocating movement denoted by the arrow 25) being placed in parallel to be able to move the toner.

Each conveying members are diagonally placed at predetermined intervals, and each space between the conveyor members forms a groove.

Each conveying unit 33 is configured of two types: for example, a 33H type and, for example, a 33K type different in a conveying direction from that of the 33H type.

In the conveying units 33A, 33B, 33H, 33M, 33N, and 33P, the toner conveying directions are those denoted by bold arrow, whilst the conveying units 33C, 33D, 33E, 33F, 33G, 33I, 33J, 33K, 33L, and 33 P are those denoted by fine-line arrows. That is, the directions of moving the toner are different from one another among the conveying units 33A to 33P.

For example, the conveying directions of the conveying units 33A, 33B, 33M, 33N, 33P, and 33G are those in which the toner is closer to the powder-full detector 34 and, for example, the conveying directions of the conveying units 33J, 33K, and 33L are those in which the toner is away from the powder-full detector 34.

On the upper-side surface of the conveying units 33N and 33P, a partitioning plate 35 extending along the cam shaft 27 is integrally formed. The partitioning plate 35 regulates a flow of powder on the upper portion of the conveying units 33N and 33P.

Among the conveying units, the space between the sheathing board portions for use in the conveying units and capable of pushing the toner for movement is different, and therefore the amount of toner moving through each conveying unit is different. That is, if the space between the sheathing board portions is increased, the amount of toner entering the space between the sheathing board portions is increased compared with the case where the space between the sheathing board portions is small.

Also, between the conveying units 33F and 33G and the conveying units 33J and 33M, a partitioning plate 36 extending in a direction orthogonal to the cam shaft 27 is integrally formed. The partitioning plate 36 regulates a flow of powder and the amount of powder flow on the right portion of the conveying units 33F and 33G and the left portion of the conveying units 33J and 33M. The partitioning plates 35 and 36 are each placed at the end of flows of toner caused by the conveying units.

Figure 4:
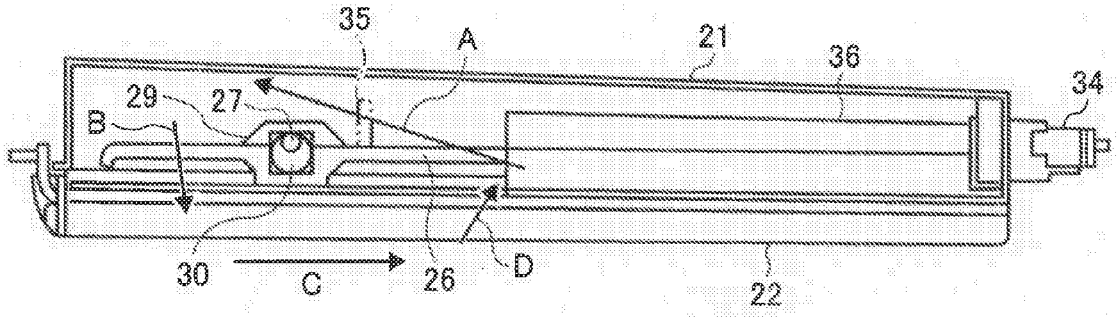
FIG. 4 is a schematic section view that depicts reciprocating movement of an agitating plate.

As shown in FIG. 4 (a schematic section view seen from the driving gear 28 side), when the cam shaft 27 is rotated with the major diameter of the eccentric cam 30 directed downward, the agitating plate 26 first moves toward the left side in the drawing as if it floats upward, as indicated by an arrow A, according to the phase of the major diameter of the eccentric cam 30 with respect to the cam receiving unit 29. Next, the agitating plate 26 moves downward as going slightly backward, as indicated by an arrow B. Then, the agitating plate 26 goes backward approximately horizontally, as indicated by an arrow C. Then, the agitating plate 26 moves diagonally upward as going slight backward, as indicated by an arrow D. These movements are repeated for performing approximately reciprocating movement as a whole. With this, at the time of moving forth (in FIG. 4, in the direction indicated by the arrow C), the agitating plate 26 moves along the bottom surface of the lower case 22, thereby causing the conveying units 33 to push the toner for movement. At the time of moving back (in FIG. 4, in the directions indicated by the arrows D and A), the agitating plate 26 floats from the bottom surface of the lower case 22, thereby causing the conveying units 33 to move while floating upward in the state where the conveying units are away from the pushed toner and the toner does not move back, that is, in the state where toner clogging occurs at the position where the toner is pushed.

With such a conveyance mechanism of the conveying units, a single driving source can cause the plural conveying units 33 with different conveying directions to simultaneously reciprocate without involvement of a gear line.

Figure 5:
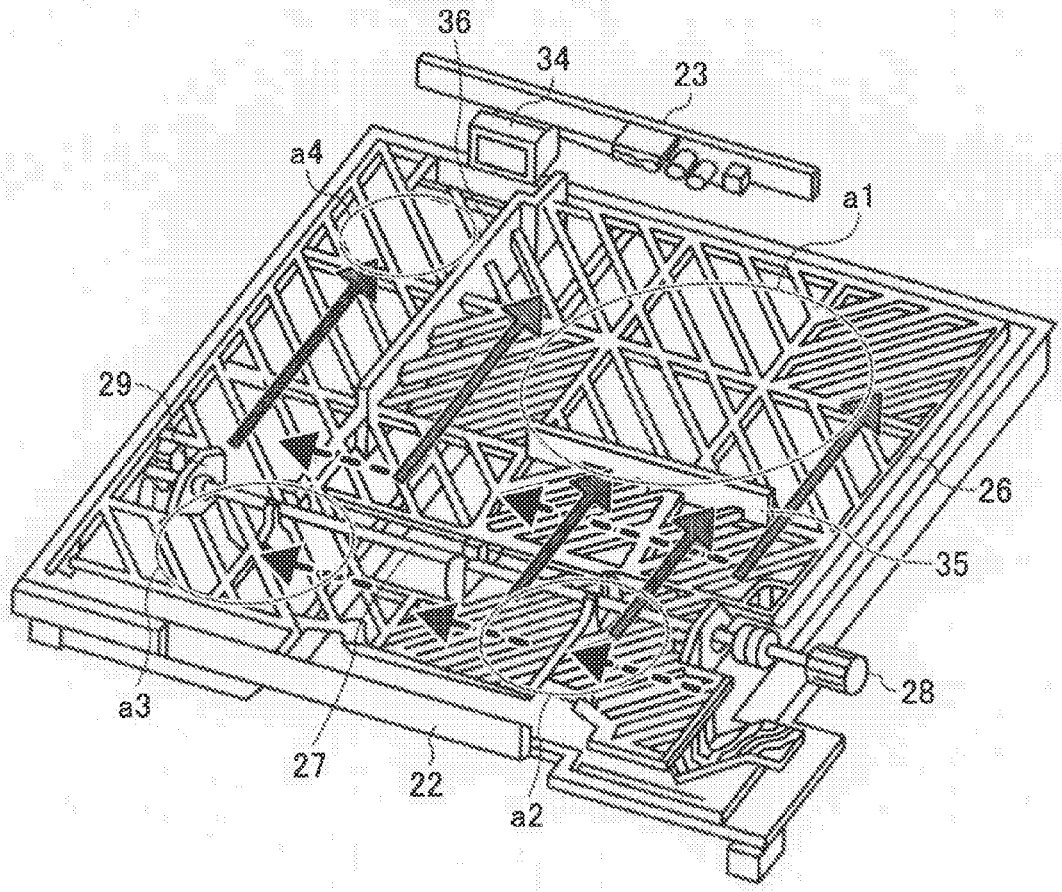
FIG. 5 is a perspective view of an overall conveyance flow in the powder collecting container.
Figure 6:
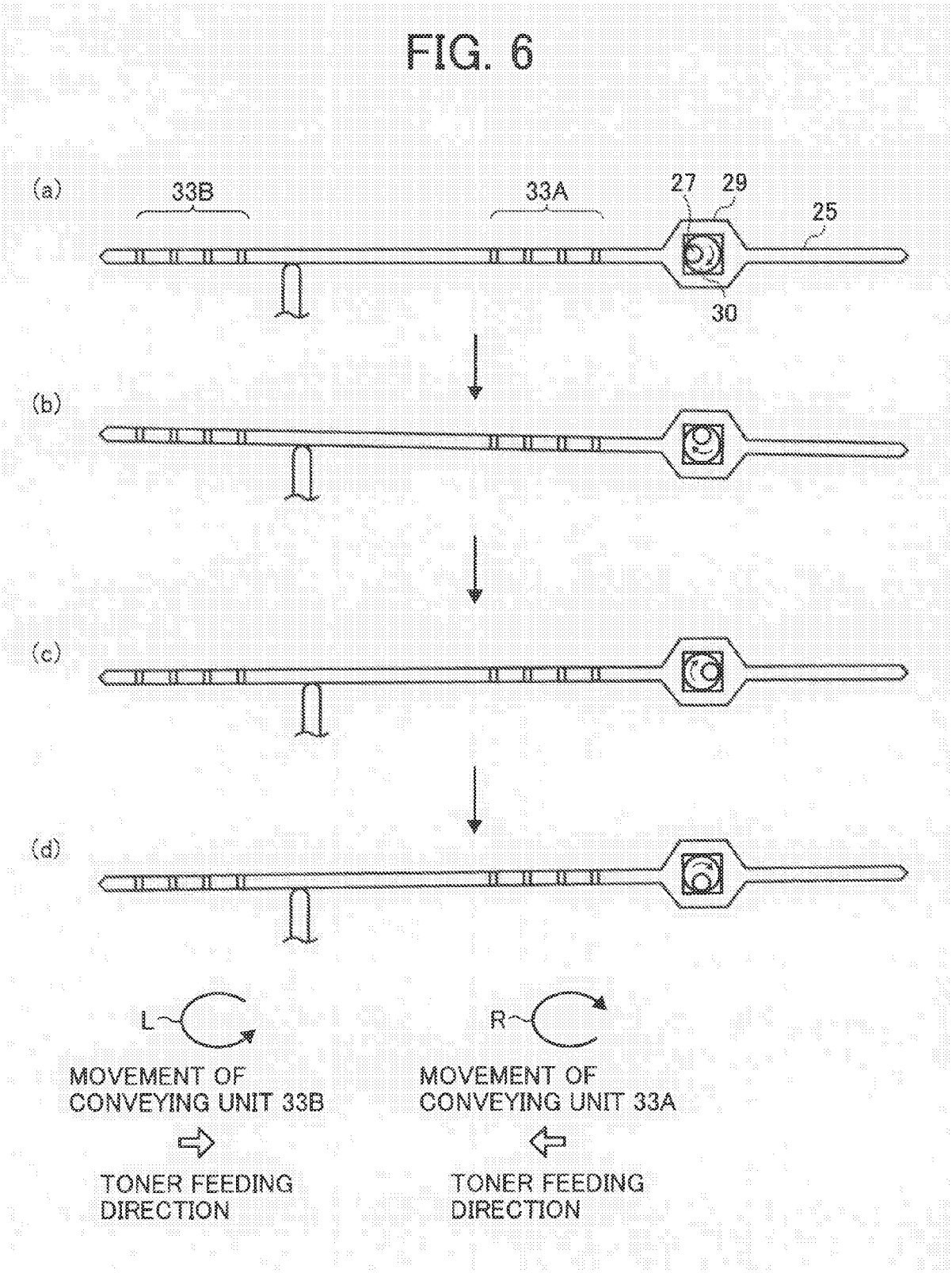
FIGS. 6A to 6D are drawings for explaining a mechanism in which, when the agitating plate is supported by supporting members, the conveying direction is reversed at the supporting member by the reciprocating movement.

With the reciprocating movement of the agitating plate 26, different flows occur at the respective conveying units. As shown in FIG. 5, as a whole, conveyance flows are as indicated by black bold arrows, resulting in formation of plural areas along the conveyance flows. That is, these plural areas are an area a1 partitioned by the partitioning plates 35 and 36, an area a2 near the powder inlet 20, an area a3 near the cam receiving unit 29, and an area a4 facing the powder-full detector 34, which is the last area in the order of the conveyance flow. Of these areas, the area a2 near the powder inlet 20 is taken as an inlet area, the area a4 facing the powder-full detector 34 is taken as a sensor area, and the area a1 located between the inlet area and the sensor area and not facing the powder-full detector 34 is taken as a reservoir area capable of storing toner. The inlet area is set larger than the sensor area. With this, the flowing toner can be prevented from being jammed at the inlet area.

Furthermore, the configuration is such that a toner outlet of the inlet area continues to an inlet of the reservoir area rather than that of the sensor area. With this, the toner introduced to the inlet area is conveyed by the conveying units to the inlet of the reservoir area. Therefore, toner clogging in the inlet area can be prevented without stopping toner conveyance in the inlet area.

With these settings of the areas and the conveying order among the areas, in the course of movement of the toner to the respective areas, the amount of toner is varied because of the regulation on the moving direction by the space between the sheathing board portions and the partitioning plates 35 and 36. With prevention of uneven distribution among the areas, before the toner container box 14 becomes full, the toner fills the area a4, which is near the powder-full detector 34 and is at the final stage of the course of conveyance.

That is, the conveyance flow as a whole can be finely controlled depending on the arrangement pattern of two types of conveying units 33 with different conveying directions. With this, it is possible to prevent a situation such that the area near the powder-full detector 34 is filled at an early stage to result in an erroneous detection.

The arrangement pattern of the conveying units 33 is not restricted to the present embodiment, an optimal pattern can be determined through experiments or the like according to the conditions, such as rheological characteristic of the toner.

As shown in FIG. 3, supporting members 40 that support the side ends of the agitating plate 26 from the lower surface side are provided to the lower case 22 near the powder-full detector 34 to face each other (omitted in FIG. 5). The function of the supporting members 40 is explained based on FIGS. 6A to 6D (schematic section views seen from the cam receiving unit 29 side).

In reciprocating movement with an end of the agitating plate 26 away from the eccentric cam 30 being supported by the supporting members 40, the toner conveying direction is reversed at the supporting members 40.

In other words, in the conveying unit 33A near the eccentric cam 30, the movement is such that the toner in the container is scooped upward from the bottom (an arrow R). Therefore, the toner conveying direction is leftward in the drawing.

On the other hand, in the conveying unit 33B, although the configuration is identical to that of the conveying unit 33A, the movement is such that the toner in the container is scooped downward from above (an arrow L). Therefore, the toner conveying direction is rightward in the drawing.

With the use of this characteristic, the supporting members 40 are placed so that a conveyance flow occurs at a portion near the powder inlet 20 in a direction away from the inlet whilst a conveyance flow occurs at a portion away from the inlet in a direction toward the inlet, thereby obtaining the conveyance flow as a whole explained above.

Figure 7A:
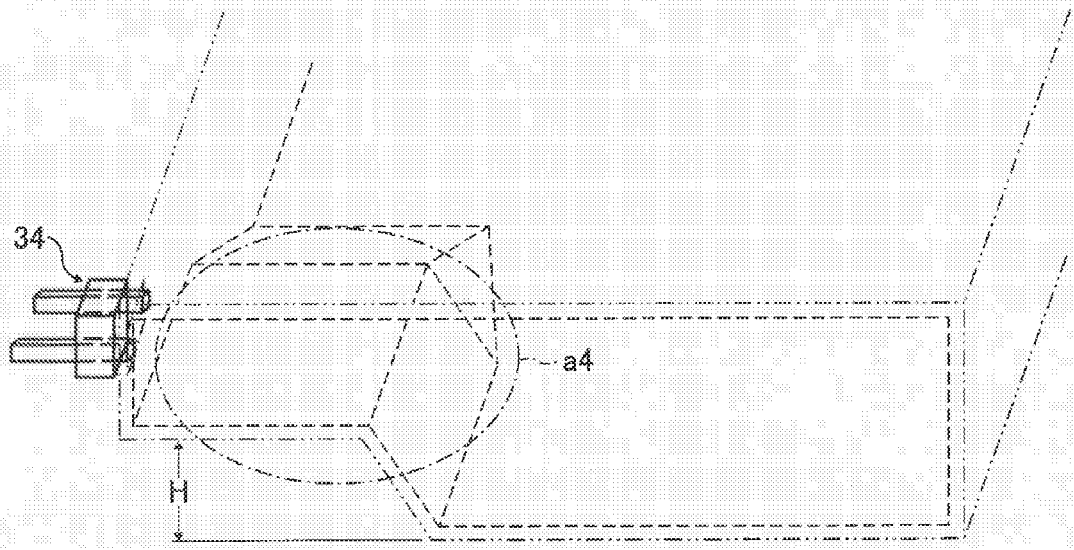
FIGS. 7A and 7B are section views of main modification examples of the conveying unit for use according to the present embodiment.
Figure 7B:
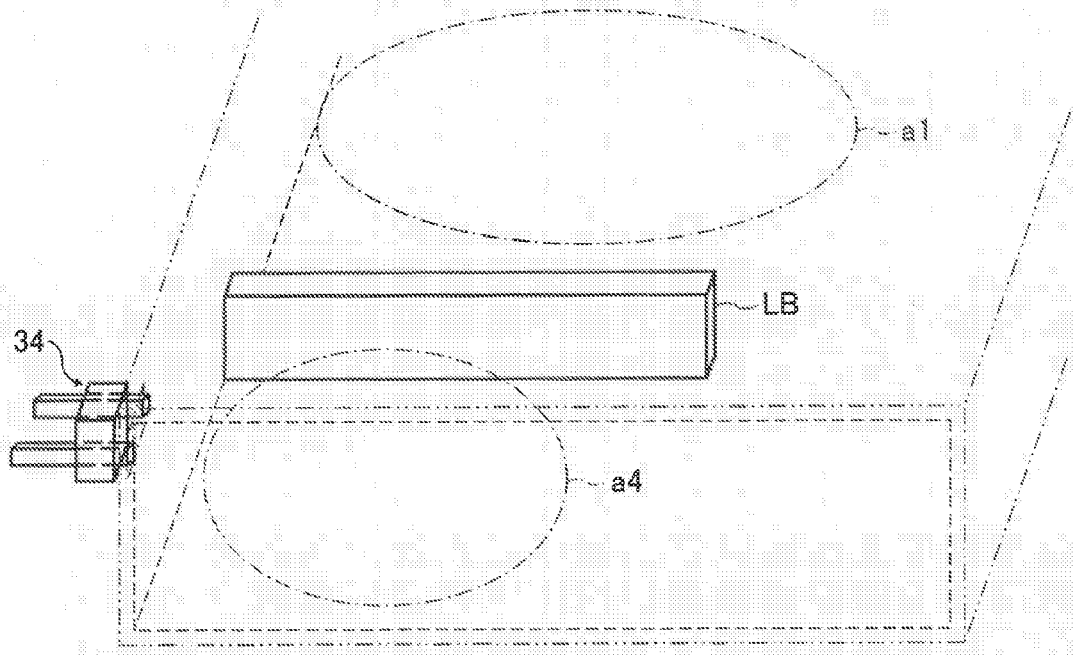

According to the present embodiment, as the configuration in which the amount of movement of toner is varied among the conveying units, a parallel space between the sheathing-board portions included in a conveying unit is varied among the conveying units. Alternatively, as shown in FIG. 7A, the configuration for regulating the toner flow can be such that the height of the bottom surface of the toner container box 14 in the area a4 facing the powder-full detector 34 is made higher than the other areas, like a bottom-up manner. With this, it is possible to regulate the toner to prevent a situation such that the sensor area is completely filled with toner before the toner container box 14 is filled due to promotion of the toner flow to the sensor area. Still alternatively, as shown in FIG. 7B, a rib LB can be provided at a boundary between the reservoir area a1 and the sensor area a4 to obtain an operation similar to that of the configuration depicted in FIG. 7A.

As described above, according to an embodiment of the present invention, the movement state of powder, such as toner, in a container is controlled with a simple configuration, thereby defining how the powder fills the container. By preventing the powder from being unevenly distributed to ensure powder movement to the position of the powder detecting unit, the accuracy of detecting the fullness of powder can be increased.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A powder container configured to be installed in a substantially horizontal manner in an apparatus in which the powder container is used, the powder container comprising:

a powder inlet through which a powder enters into the powder container;

a powder detecting unit that includes a powder detector for detecting a full of the powder; and a powder conveying unit that is provided between the powder inlet and the powder detecting unit, wherein a space between the powder inlet and the powder detecting unit is divided into a plurality of areas.

2. The powder container according to claim 1, wherein the areas include an inlet area near the powder inlet, a detecting area near the powder detector, and a reservoir area for accumulating the powder.

3. The powder container according to claim 2, wherein the inlet area is larger than the detecting area.

4. The powder container according to claim 2, further comprising:

a conveying unit that conveys the powder from the powder inlet to an outlet of the inlet area.

5. The powder container according to claim 2, further comprising:

a conveying unit that conveys the powder from an inlet of the detecting area to the powder detector.

6. The powder container according to claim 2, further comprising:

an outlet of the inlet area is closer to an inlet of the reservoir area than to the detecting area.

7. The powder container according to claim 2, further comprising:

a conveying unit that conveys the powder from an outlet of the inlet area to an inlet of the reservoir area.

8. The powder container according to claim 1, further comprising:

a plurality of conveying units provided in each of the areas, the conveying units having different conveying directions at different positions.

9. The powder container according to claim 8, wherein the conveying units are capable of moving back and forth on a horizontal plane.

10. The powder container according to claim 1, further comprising:

a partitioning member that separates each of the areas.

11. The powder container according to claim 10, wherein the partitioning member is capable of moving.

12. The powder container according to claim 1, wherein the areas are separated by different heights of bottom surfaces of the areas.

13. The powder container according to claim 1, wherein the areas are separated by a rib that is provided on a bottom surface at a boundary between the areas.

14. The powder container according to claim 1, wherein the areas are not completely separated from each other.

15. A toner container comprising:

a powder container configured to be installed in a substantially horizontal manner in an apparatus in which the powder container is used, wherein the powder container includes a powder inlet through which a powder enters into the powder container, a powder detecting unit that includes a powder detector for detecting a full of the powder, and a powder conveying unit that is provided between the powder inlet and the powder detecting unit, and a space between the powder inlet and the powder detecting unit is divided into a plurality of areas.

16. An image forming apparatus comprising:

a toner container that includes a powder container configured to be installed in a substantially horizontal manner in an apparatus in which the powder container is used, wherein the powder container includes a powder inlet through which a powder enters into the powder container, a powder detecting unit that includes a powder detector for detecting a full of the powder, and a powder conveying unit that is provided between the powder inlet and the powder detecting unit, and a space between the powder inlet and the powder detecting unit is divided into a plurality of areas.

17. A powder container configured to be installed in a substantially horizontal manner in an apparatus in which the powder container is used, the powder container comprising:

a powder inlet through which a powder enters into the powder container;

a powder detecting unit that has a reservoir space where the powder is accumulated, an accumulated powder in the reservoir space being detected by a powder detector installed in the apparatus; and a powder conveying unit that is provided between the powder inlet and the powder detecting unit, wherein a space between the powder inlet and the powder detecting unit is divided into a plurality of areas.

18. The powder container according to claim 17, wherein the areas include an inlet area near the powder inlet, a detecting area near the powder detector, and a reservoir area for accumulating the powder.

19. The powder container according to claim 18, wherein the inlet area is larger than the detecting area.

20. The powder container according to claim 18, further comprising:

a conveying unit that conveys the powder from the powder inlet to an outlet of the inlet area.

21. The powder container according to claim 18, further comprising:

a conveying unit that conveys the powder from an inlet of the detecting area to the powder detector.

22. The powder container according to claim 18, further comprising:

an outlet of the inlet area is closer to an inlet of the reservoir area than to the detecting area.

23. The powder container according to claim 18, further comprising:

a conveying unit that conveys the powder from an outlet of the inlet area to an inlet of the reservoir area.

24. The powder container according to claim 17, further comprising:

a plurality of conveying units provided in each of the areas, the conveying units having different conveying directions at different positions.

25. The powder container according to claim 24, wherein the conveying units are capable of moving back and forth on a horizontal plane.

26. The powder container according to claim 17, further comprising:

a partitioning member that separates each of the areas.

27. The powder container according to claim 26, wherein the partitioning member is capable of moving.

28. The powder container according to claim 17, wherein the areas are separated by different heights of bottom surfaces of the areas.

29. The powder container according to claim 17, wherein the areas are separated by a rib that is provided on a bottom surface at a boundary between the areas.

30. The powder container according to claim 17, wherein the areas are not completely separated from each other.

31. A toner container comprising:

a powder container configured to be installed in a substantially horizontal manner in an apparatus in which the powder container is used, wherein the powder container includes a powder inlet through which a powder enters into the powder container, a powder detecting unit that has a reservoir space where the powder is accumulated, an accumulated powder in the reservoir space being detected by a powder detector installed in the apparatus, and a powder conveying unit that is provided between the powder inlet, and the powder detecting unit, and a space between the powder inlet and the powder detecting unit is divided into a plurality of areas.

32. An image forming apparatus comprising:

a toner container that includes a powder container configured to be installed in a substantially horizontal manner in an apparatus in which the powder container is used, wherein the powder container includes a powder inlet through which a powder enters into the powder container, a powder detecting unit that has a reservoir space where the powder is accumulated, an accumulated powder in the reservoir space being detected by a powder detector installed in the apparatus, and a powder conveying unit that is provided between the powder inlet and the powder detecting unit, and a space between the powder inlet and the powder detecting unit is divided into a plurality of areas.

* * * * *